US006572739B2

(12) United States Patent
Matsuura et al.

(10) Patent No.: US 6,572,739 B2
(45) Date of Patent: Jun. 3, 2003

(54) ELECTROLYTIC APPARATUS FOR FORMING A SUPPORT FOR LITHOGRAPHIC PRINTING PLATE

(75) Inventors: Atsushi Matsuura, Shizuoka (JP); Akio Uesugi, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/764,099

(22) Filed: Jan. 19, 2001

(65) Prior Publication Data

US 2001/0027925 A1 Oct. 11, 2001

(30) Foreign Application Priority Data

Jan. 19, 2000 (JP) ..... 2000-010631

(51) Int. Cl.[7] ..... C25D 17/00; C25B 9/00
(52) U.S. Cl. ..... 204/199; 204/279
(58) Field of Search ..... 204/198, 199, 204/279

(56) References Cited

U.S. PATENT DOCUMENTS 3,559,927 A * 2/1971 Baekken ..... 244/115
4,476,006 A 10/1984 Ohba et al.
5,188,032 A * 2/1993 Lewis et al. ..... 101/453
5,314,607 A * 5/1994 Kaneko et al. ..... 204/206
5,589,307 A * 12/1996 Takeuchi ..... 430/130
6,015,009 A * 1/2000 Allen ..... 166/88.2
6,232,037 B1 * 5/2001 Uesugi et al. ..... 101/454
6,294,313 B1 * 9/2001 Kobayashi et al. ..... 101/453

FOREIGN PATENT DOCUMENTS

JP 62-25117 3/1981

* cited by examiner

*Primary Examiner*—Donald R. Valentine
(74) *Attorney, Agent, or Firm*—Sughrue Mion, PLLC

(57) ABSTRACT

An electrolytic apparatus, for supporting a lithographic printing plate, including a guide roller for transporting an aluminum web. The guide roller includes a skeleton section formed with a strong material, a liquid contact section on the surface of the skeleton section, and a nonwoven fabric is provided on the liquid contact section and contacts a surface of an aluminum web. The liquid contact section is formed with a fluororesin coating of 100–3000 $\mu$m in thickness, and the insulation resistance value of the fluororesin coating is $10^5$ Ωcm or more in volume resistivity. The nonwoven fabric is formed mainly with polyphenylene sulfite or fluororesin of 5–50 mm in thickness. Additionally, the nonwoven fabric is condensed in the direction of the guide roller axis, and is treated with a surface finish so as to have a surface hardness in the range of 50–95.

4 Claims, 2 Drawing Sheets

ELECTROLYTIC APPARATUS FOR FORMING A SUPPORT FOR LITHOGRAPHIC PRINTING PLATE

FIELD OF THE INVENTION

This invention relates to electrolytic apparatus and electrolytic method of support for lithographic printing plate electrochemically roughening the surface of aluminum web used for support for pre-sensitized plate. More specifically, this invention relates to the electrolytic apparatus and electrolytic method with a guide roller that formed with specified structure and material.

BACKGROUND OF THE INVENTION

In general, aluminum web is used as support for pre-sensitized plate, and the surface of the aluminum web is roughened like sandblasted for the purpose of improving the adhesion with the sensitive layer applied to the surface, or for the purpose of maintaining the wetting water in the process of printing, and so on.

As the means of roughening the surface of the aluminum web like sandblasted, Japanese Patent KOKOKU 62-25117 discloses, for example, the electrolytic apparatus reserving electrolyte in an electrolytic bath, installing a guide roller in the electrolytic bath, and electrolyticaly processing the surface of the aluminum web while conveying the aluminum web circularly backed by the guide roller.

However, in the above-mentioned traditional electrolytic apparatus, high-temperature electrolytic process was prohibited, for the reason of remarkable degradation of rubber that covers the surface of the metal guide roller in the high-temperature electrolytic process in which printing performance would be superior, because the guide roller was formed with covering rubber and metal core in traditional electrolytic apparatus.

That is to say, it is known that although by making the pits formed with roughening by electrochemical electrolytic treatment fine, printing performance is improved and running cost is reduced dramatically, and it is necessary to increase the temperature of electrolyte of electrochemical treatment higher than 60° C. in order to make the pits fine. However, because the duration of life of the rubber would be about 1 month in the case where the temperature of electrolyte is higher than 60° C., the high-temperature electrolytic treatment of higher than 60° C. was not practical.

The primary object of this invention is to solve the above-described problems, and to provide electrolytic apparatus and electrolytic method of support for lithographic printing plate where the guide roller does not deteriorate or degrade in high-temperature nitric acid electrolytic treatment.

Another object of this invention is to provide the electrolytic apparatus and electrolytic method of support for lithographic printing plate that can be used for high-temperature nitric acid electrolytic treatment for a long time.

SUMMARY OF THE INVENTION

The inventor of the present invention examined structure and material of guide roller in order to achieve above-described object.

Electrolytic apparatus of support for lithographic printing plate of this invention is the apparatus that electrolyticaly treats aluminum web in acid electrolyte wherein the guide roller for aluminum web transportation basically comprises a skeleton section, a liquid contact section, and nonwoven fabric.

By adopting such a structure, it was found that such guide roller of the treble structure does not suffer any deformation, any change in quality for a long term, and that it is not frequent to scratch the aluminum web.

Electrolytic apparatus of support for lithographic printing plate of this invention is the apparatus that electrolyticaly treats aluminum web in acid electrolyte wherein the guide roller for aluminum web transportation comprises a skeleton section formed with strong material of intensity, a liquid contact section on the surface of the skeleton section, and nonwoven fabric which is provided on the contact surface with the aluminum web.

The liquid contact section on the surface of the skeleton section is formed with fluororesin coating of 100–3000 $\mu$m in thickness and the insulation resistance value of the fluororesin coatings is $10^5$ Ωcm or more in volume resistivity.

The nonwoven fabric that is provided on the contact surface with the aluminum web is formed mainly with polyphenylene sulfite or fluororesin of 5–50 mm in thickness.

In addition, the nonwoven fabric is condensed in the direction of the guide roller axis, and the nonwoven fabric is treated with the surface finish up to the range of 50–95 in surface hardness.

In the electrolytic apparatus of support for lithographic printing plate of this invention, both the roller skeleton section and the fluid contact section of the guide roller shares the intensity, the acid resistance, and the insulating ability in a way that the roller skeleton section principally takes charge of intensity, and the fluid contact section takes charge of acid resistance and insulating ability. Therefore, the intensity, the acid resistance, and the insulating ability are insured completely and reduction of the weights of the material of these sections is designed. Accordingly, the intensity, the acid resistance, and the insulating ability are insured at the same time in this invention while in the prior art, it was impossible for the guide roller formed with the polyvinyl chloride or the rubber as the material to insure these performance.

Moreover, the nonwoven fabric enables to convey the aluminum web without injuring.

DESCRIPTION OF THE PREFERRED EMBODIMENTS

Figure 1:
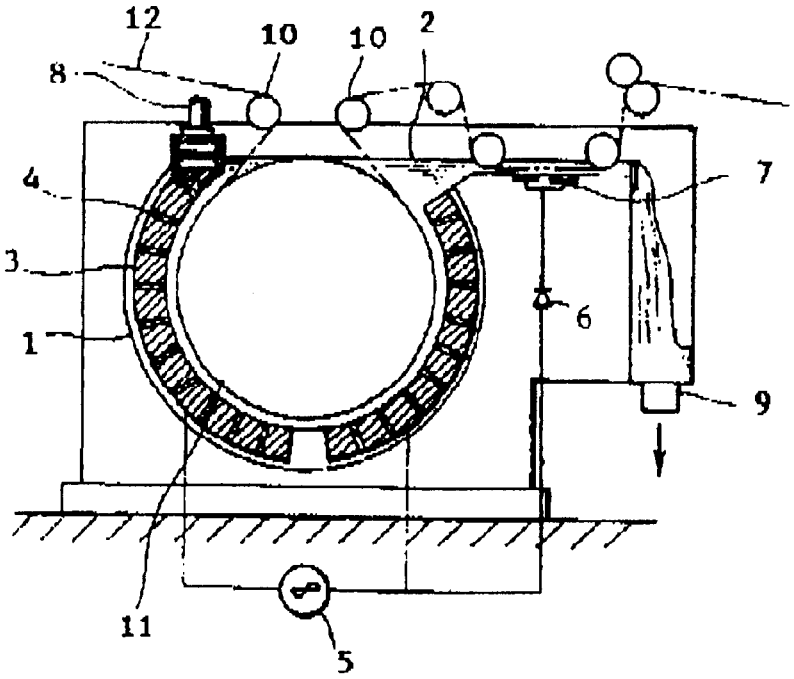
FIG. 1 is a schematic sectional side view to show an example of electrolytic apparatus of support for lithographic printing plate in accordance with this invention.

As the material of the roller skeleton section, strong material of intensity of the degree which can maintain configuration when assembled as the guide roller is applicable and, for example, metal is suitable. As the metal for the material of the roller skeleton section, SUS304, SUS316, stainless steel, aluminum, etc., are desirable. It is desirable for the tensile strength of the roller skeleton section to be 60N/mm$^2$ or more, and more desirable to be 100N/mm$^2$ or more. In the case where the tensile strength of the roller skeleton section is less than 60N/mm$^2$, it is not enough, and it is probable for the guide roller to deteriorate. The measuring method of tensile strength follows JISZ2241.

As the material of the fluid contact section of the guide roller, strong material of high acid resistance and of high heat-resistant is applicable and, for example, polyvinyl chloride, fluororesin, ceramic, polyphenylene sulfite (PPS) resin, etc., are suitable. Among this material, fluororesin is desirable because it is superior in workability, acid resistance, thermostability, and insulating ability. As the procedure for forming the fluid contact section of the guide roller, stratified formation by coating can be applicable.

Regarding the coating thickness of fluororesin to be used for the fluid contact section of the guide roller, it is desirable to be 2–5000 $\mu$m, and more desirable to be 100–3000 $\mu$m. In the case where the coating thickness of fluororesin to be used for the fluid contact section of the guide roller is less than 2 $\mu$m, it is impossible for the guide roller to assure enough insulation resistance value.

In addition, when coating thickness of fluororesin exceeds 5000 $\mu$m, fabrication is difficult, and a cost becomes expensive.

As for the insulation resistance value of the fluid contact section of the guide roller, $10^5$ Ωcm or more in volume resistivity is desirable. In the case where the volume resistivity is less than $10^5$ Ωcm, it becomes difficult to lengthen durability of the guide roller.

As the material of the nonwoven fabric, the material of large acid resistance, thermo stable and large abrasion resistance which is hard to give a scratch to the aluminum web even when foreign body contamination will occur between the aluminum web and the nonwoven fabric is applicable.

Typical examples as the material of the nonwoven fabric are polyphenylene sulfite (PPS) resin, fluororesin, polypropylene resin, polyethylene resin, polyvinyl chloride resin, etc., and among these, polyphenylene sulfite (PPS) resin and fluororesin are desirable.

Regarding the thickness of the nonwoven fabric, it is desirable to be 1–100 mm, and more desirable to be 5–50 mm. In the case where the thickness of the nonwoven fabric is less than 1 mm, it is impossible for the guide roller to obtain enough attrition durability under the condition of constant contact with the aluminum web.

In addition, when the thickness of the nonwoven fabric exceeds 100 mm, the effect of scratch resistance for aluminum will decrease, and also a cost becomes expensive.

Regarding the surface hardness of nonwoven fabric, it is desirable to be 50–95, and more desirable to be 60–85. In the case where the surface hardness of the nonwoven fabric becomes less than 50, it is difficult to keep the surface smoothness of the aluminum web.

In the case where surface hardness exceeds 95, a crack is easy to appear on the surface of the aluminum web when foreign body mixes in between the aluminum web and the nonwoven fabric. Determination of surface hardness follows JISK6250 using "RUBBERHARDNESSTESTER" manufactured by TECHROCK Company.

Surface finish is treated to the nonwoven fabric, and by this surface finish, the surface hardness of the nonwoven fabric is arranged to become among the above-described range.

Referring now to the accompanying drawings where preferred embodiments of the electrolytic apparatus of support for lithographic printing plate by the present invention will be described.

Figure 2:
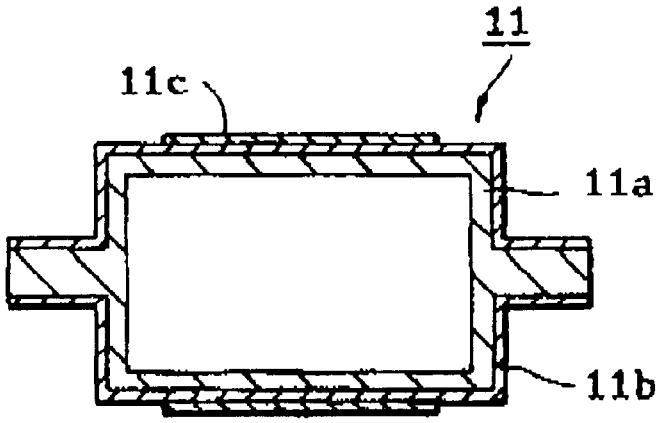
FIG. 2 is a cross sectional plan view showing structure of example of guide roller to use for electrolytic apparatus in accordance with this invention.

FIG. 1 is schematic sectional side view to show an example of electrolytic apparatus of support for lithographic printing plate of the present invention, and FIG. 2 is cross sectional plan view of guide roller to use for the electrolytic apparatus.

Electrolytic apparatus shown in FIG. 1 is of intermittent supplying radial cell type, electrolyte 2 is reserved in electrolytic treatment bath 1. Lots of electrodes 3 are provided with intervening insulating plate 4 along circumference side of this electrolytic treatment bath 1, and these each electrode 3 is connected to feed electrode 7 through AC power source 5 and diode 6.

Electrolyte feed-pipe 8 is connected to an upper part of the electrolytic treatment bath 1, and electrolyte discharge pipe 9 is connected to another lower part of the electrolytic treatment bath 1.

These electrolyte feed-pipe 8 and electrolyte discharge pipe 9 are connected to stock tank (not shown) that reserves electrolyte 2. In addition, pass roller 10 is provided over the electrolytic treatment bath 1, a cylindrical guide roller 11 is provided in the electrolytic treatment bath 1, and transportation path of aluminum web 12 consists of these pass roller 10 and guide roller 11. As shown in FIG. 2, guide roller 11 has the roller skeleton section 11*a* and the fluid contact section of the guide roller 11*b* formed on the surface of the roller skeleton section 11*a,* and nonwoven fabric 11*c* is attached to the surface where the fluid contact section of the guide roller 11*b* touches to aluminum web.

Figure 3:
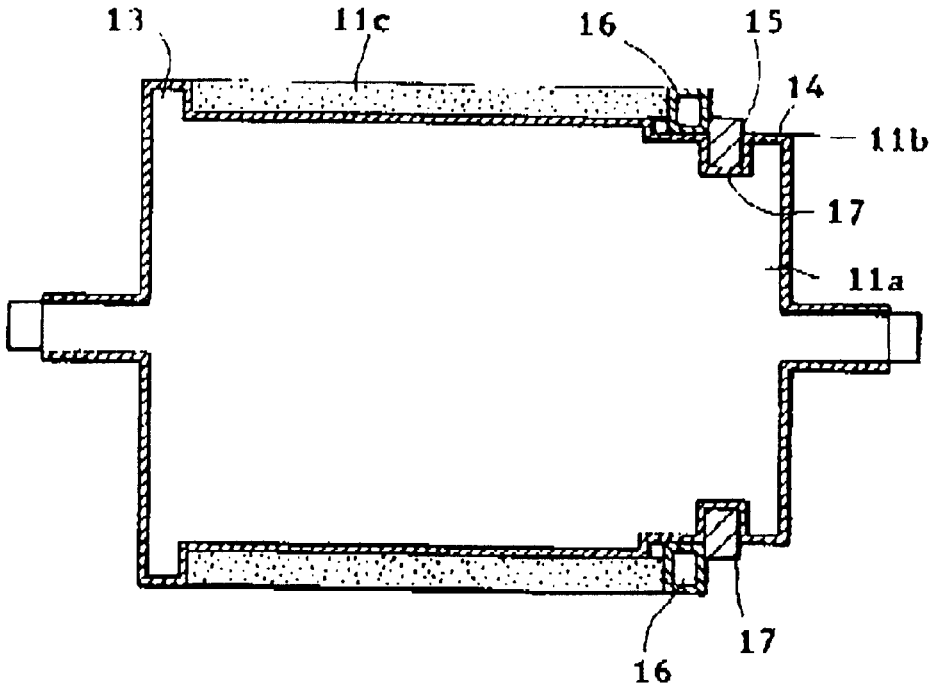
FIG. 3 is a cross sectional plan view showing structure of another example of guide roller to use for electrolytic apparatus in accordance with this invention.

FIG. 3 is cross sectional plan view showing another embodiment of the guide roller used for the present invention. In FIG. 3, the guide roller 11 consists of the roller skeleton section 11*a,* locking portion 13 of disc shape formed on one side of the roller skeleton section 11*a,* step portion 14 having a smaller radius than the skeleton section 11*a* formed on another side of the roller skeleton section 11*a,* and plurality of dimple 15 formed on the step portion 14. The nonwoven fabric 11*c* covers the roller skeleton section 11*a* in the way that one edge contacts with the locking portion 13 and another edge wraps the step portion 14, where junk plate ring 16 holds the nonwoven fabric 11*c*. The junk plate ring 16 is a cylindrical metal plate ring with fluororesin coating on the surface of itself. To the outside of junk plate ring 16, fixing jig 17 that was able to fit with dimple 15 is arranged, and fix nonwoven fabric 11*b* with the condition which pressed through junk plate ring 16 by this fixing jig 17. The fixing jig 17 comprises many blocks that are divided from a ring shape assembly, and are formed with polyvinyl chloride or heat-resistance polyvinyl chloride. Such fixing jig 17 is fixed in the roller skeleton section 11*a* with fastening means (not shown) such as volt, welding.

Figure 4:
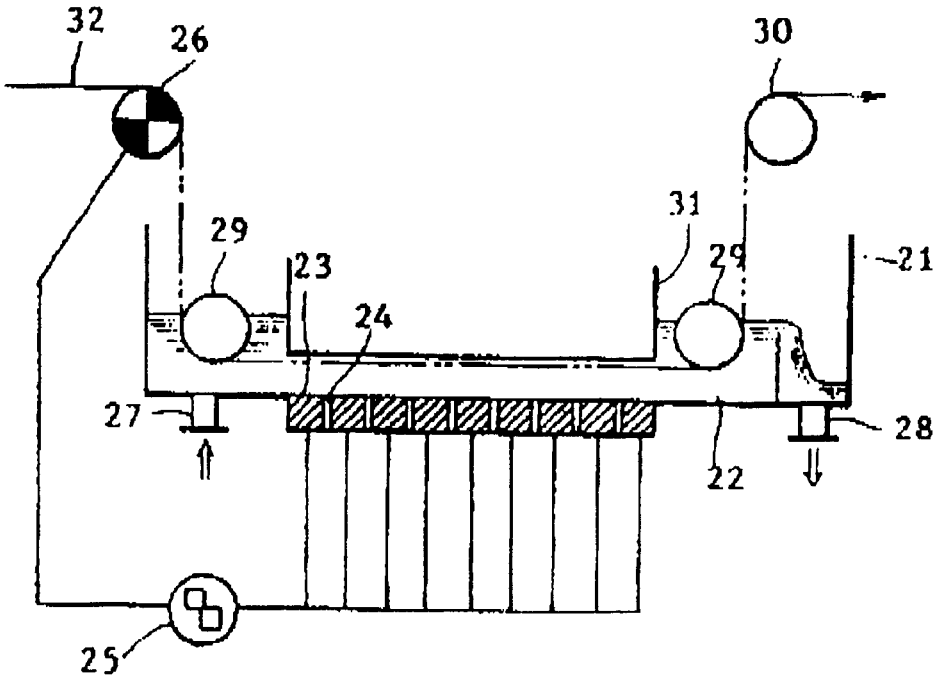
FIG. 4 is a schematic sectional side view to show another example of electrolytic apparatus of support for lithographic printing plate in accordance with this invention.

FIG. 4 is a schematic sectional side view to show another example of electrolytic apparatus of support for lithographic printing plate in accordance with this invention. Electrolytic apparatus shown in FIG. 4 is of direct supplying flat cell type, and electrolyte 22 is reserved in electrolytic treatment bath 21. Under the bottom plate of the electrolytic treatment bath 21, lots of electrodes 23 are provided with intervening insulating plate 24, and these each electrode 23 is connected to feed roller 26 through AC power source 25.

At force end of the bottom plate of the electrolytic treatment bath 21, electrolyte feed-pipe 27 is connected, and at rear end of the bottom plate of the electrolytic treatment bath 21, electrolyte discharge pipe 28 is connected, and, these electrolyte feed-pipe 27 and electrolyte discharge pipe 28 are connected to a stock tank (not shown) which reserves electrolyte 22. In addition, a pair of guide roller 29 is provided under the state of being soaked in electrolyte 22 within the electrolytic treatment bath 21, and pass roller 30 is provided over the electrolytic treatment bath 21.

On the other hand, guide plate 31 is arranged between a pair of the guide roller 29 in the electrolyte 22, and transportation path of aluminum web 32 consists of these feed roller 26, a pair of guide roller 29, guide plate 31, and pass roller 30.

In this electrolytic apparatus, guide roller 29 is formed with the roller skeleton section, the fluid contact section of the guide roller, and nonwoven fabric in the same way as guide roller 11 shown in FIG. 2 or FIG. 3.

EXAMPLE

Example 1

Durability test of the guide roller of the present invention

Durability test of the guide roller by the design shown in FIG. 3 was examined using the electrolytic treatment apparatus shown in FIG. 1.

Electrolytic treatment condition

Electrolyte: 2% $HNO_3$

Temperature of the electrolyte: 80° C.

Traveling speed of the aluminum web: 10 m/minute

Experimental findings are shown in TABLE 1.

Evaluation depends on the condition as the following:

Excellent: Even if foreign body equal to or more than 0.5 mm entered between the aluminum web and the guide roller, the compression-caused damage did not occur.

Good: When foreign body equal to or more than 0.5 mm entered between the aluminum web and the guide roller, compression-caused damage occurs. However, no compression-caused damage occurs in routine.

TABLE 1

| | | Example 1 Metal | Comparative Example 1 Metal | Comparative Example 2 Metal | Prior Art Metal |
|---|---|---|---|---|---|
| Liquid Contact Section | Resin | Fluororesin | Fluororesin | Fluororesin | Rubber |
| | Thickness | 500 μm | 100 μm | 500 μm | 30 mm |
| | Volume Resistance | 10' Ωcm | $10^{-1}$ Ωcm | $10^{7}$ Ωcm | $10^{7}$ Ωcm |
| | Surface Hardness | — | — | — | 60 |
| Nonwoven Fabric | Resin | PPS Resin | PPS resin | PPS resin | — |
| | Thickness | 30 mm | 30 mm | 30 mm | |
| | Surface Hardness | 80 | 80 | 97 | |
| Duration of life (years) | | 2.5 or more | 1.2 | 2.5 or more | 1 |
| Cracks on the Aluminum Web | | Excellent | Excellent | Good | Excellent |

As the result, the guide roller of the prior art consisted of rubber became unusable after one month of practical usage.

On the contrary, the guide roller of Example 1 showed no change even after more than 2.5 years of practical usage, and no injury to the aluminum web was found.

Example 2

When the fluorocarbon resin coating to the guide roller was regulated to be thin, sufficient insulation resistance was not achieved, and duration of life was short, e.g. one or two years.

Example 3

In the case where the surface hardness of the guide roller was higher than the suitable value, a scratch to the aluminum web surface occurred.

According to the present invention, the guide roller does not deteriorate, degrade or suffer damages in the electrolyte of high temperature (60–90° C.).

Besides, the electrolytic apparatus and electrolytic method of support for lithographic printing plate of the present invention can be used for electrolytic treatment for a long term without injuring the aluminum web.

Therefore, the printing performance is improved and running cost of the electrolytic treatment is reduced dramatically according to the present invention.

It is further understood by those skilled in the art that the foregoing description is a preferred embodiment of the invention and that various changes and modifications may be made in the invention without departing from the spirit and scope thereof.

What is claimed is:

1. Electrolytic apparatus, for forming a support for a lithographic printing plate, comprising:

an electrode; and a guide roller comprising a skeleton section formed with a strong material, a liquid contact section on the surface of the skeleton section, and a nonwoven fabric which is provided on the liquid contact section and is for contacting with a metal web, wherein said roller skeleton section has a locking portion of disc shape formed on one side of said roller skeleton section, a step portion having a smaller radius than said skeleton section and formed on another side of said roller skeleton section, and a plurality of dimples formed on said step portion, and wherein said nonwoven fabric covers said roller skeleton section so that one edge thereof contacts with said locking portion and another edge thereof wraps said step portion, and further wherein a junk plate ring holds said nonwoven fabric.

2. Electrolytic apparatus, for forming a support for a lithographic printing plate, comprising:

an electrode; and a guide roller that comprises a skeleton section formed with a strong material, a liquid contact section on the surface of the skeleton section, and nonwoven fabric which is provided on the liquid contact section and which is for contacting with an aluminum web, wherein said liquid contact section is formed with a fluororesin coating, and further wherein said nonwoven fabric comprises polyphenylene sulfite resin or fluororesin.

3. Electrolytic apparatus as claimed in claim 2, wherein:

the thickness of said fluororesin coating is from 2 μm to 5000 μm;

the insulation resistance value of the liquid contact section of the guide roller is $10^5$ Ωcm or more in volume resistivity;

the thickness of said nonwoven fabric is from 1 mm to 100 mm; and the surface hardness of said nonwoven fabric is from 50 to 95.

4. Electrolytic apparatus as claimed in claim 3, wherein said roller skeleton section has a locking portion of disc shape formed on one side thereof, a step portion, having a smaller radius than said skeleton section, is formed on another side of said roller skeleton section, and a plurality of dimples is formed on said step portion, wherein said nonwoven fabric covers said roller skeleton section so that one edge thereof contacts with said locking portion and another edge thereof wraps said step portion, and further wherein a junk plate ring holds said nonwoven fabric.

* * * * *